US007069869B2

(12) United States Patent
Kashina

(10) Patent No.: US 7,069,869 B2
(45) Date of Patent: Jul. 4, 2006

(54) THREAD TENSION REGULATING APPARATUS FOR AN OVER-LOCK SEWING MACHINE

(75) Inventor: Yoshihiro Kashina, Higashi-Osaka (JP)

(73) Assignee: Hosei Mishin Seizo Kabushiki Kaisha, Osaka (JP)

( * ) Notice: Subject to any disclaimer, the term of this patent is extended or adjusted under 35 U.S.C. 154(b) by 0 days.

(21) Appl. No.: 11/029,480

(22) Filed: Jan. 6, 2005

(65) Prior Publication Data

US 2006/0060117 A1 Mar. 23, 2006

(30) Foreign Application Priority Data

Sep. 22, 2004 (JP) ..... 2004-274385

(51) Int. Cl.
*D05B 47/00* (2006.01)

(52) U.S. Cl. ..... 112/254

(58) Field of Classification Search ..... 112/254, 112/255, 302, 475.26; 242/149, 150
See application file for complete search history.

(56) References Cited

U.S. PATENT DOCUMENTS 5,265,548 A * 11/1993 Satoma ..... 112/254
5,860,376 A * 1/1999 Tseng ..... 112/255
6,055,920 A * 5/2000 Hori ..... 112/443

FOREIGN PATENT DOCUMENTS

JP 2686188 8/1997

* cited by examiner

*Primary Examiner*—John J. Calvert
*Assistant Examiner*—Brian Kauffman
(74) *Attorney, Agent, or Firm*—Wenderoth, Lind & Ponack, L.L.P.

(57) ABSTRACT

A thread tension regulating apparatus for an over-lock sewing machine is disclosed, wherein there are provided between an adjusting knob and a home position returning lever a first interlock device for displacing a home position returning lever in response to motion of the adjusting knob displacing from a home position in a pressurizing direction, and a second interlock device for displacing the home position returning lever in response to motion of the adjusting knob of the thread tension unit displacing from the home position in a depressurizing direction. These two interlock devices are provided respectively with an interlock obviating device for causing the second interlock device to take a non-operating condition when the first interlock device operates, and an interlock obviating device causing the first interlock device to take a non-operating condition when the second interlock device operates.

12 Claims, 5 Drawing Sheets

THREAD TENSION REGULATING APPARATUS FOR AN OVER-LOCK SEWING MACHINE

TECHNICAL FIELD

The present invention relates to a thread tension regulating apparatus for an over-lock sewing machine. The invention is characterized by having a simplified home position returning device of a thread tension unit, thereby making the unit easier to use and possible to be offered at a reduced cost.

BACKGROUND ART

A thread tension regulating apparatus set on an over-lock sewing machine has been equipped, for example, as in patent literature 1, with a mobile member which is driven by rotation of a thread tension unit in both a depressurizing direction and a pressurizing direction, and thus with a home position returning apparatus which is designed to have the thread tension unit return to the home position by operating home position returning levers on two sides of a swinging scope of the mobile member, respectively.

Patent Literature 1 Patent No. 2686188 Gazette

The thread tension regulating apparatus of Patent literature 1 equipped with the home position returning apparatus of the thread tension unit which is constituted as above and operates as above, is required to be equipped with the home position returning device by each of plural sets of a thread tension unit set on a dial tension shaft, and each home position returning device to be equipped with two side levers for returning to the home position respectively on both sides of the mobile member which moves in the pressuring direction and depressurizing direction. Accordingly, this device has such drawbacks as complication in structure with higher cost requirement and greater labor requirement for performing a returning operation.

In view of the above, an object of the invention is to simplify structure of a home position returning device to be annexed to a thread tension unit and make it possible to reduce cost, and also to facilitate use of an over-lock sewing machine by allowing a returning operation to be simply performed.

SUMMARY OF THE INVENTION

Thus, in order to meet the object as above, the present invention provides a thread tension regulating apparatus for an over-lock sewing machine comprising a batch conversion device including: a plurality of thread tension regulation cams for setting a thread tension pressure adapted to a sewing method fixed respectively to a dial cam shaft; swinging pieces which perform swinging motions according to a set lift of the tension regulation cams, respectively; a plurality of spring bearings provided on the dial tension shaft so as to be rotatable via engagement with tip portions of respective swinging pieces; and thread tension discs forming set thread tension pressures respectively under a spring force supported by respective spring bearings. The thread tensioning regulating apparatus also comprises a fine adjustment device for finely adjusting the set thread tension pressures of respective thread tension discs with respective adjusting knobs. Also, there are provided two interlock devices comprising a first interlock device for displacing a home position returning lever toward a home position returning operation lever in response to motion of an adjusting knob of a thread tension device from a home position in a pressurizing direction, and a second interlock device for displacing the home position returning lever toward the home position returning operation lever in response to motion of the adjusting knob of the thread tension device from the home position in a depressurizing direction. These interlock devices are provided between the adjusting knob and the home position returning operation lever, and these two interlock devices are provided respectively with an interlock obviating device for causing the second interlock device to take a non-operating condition when the first interlock device operates, and an interlock obviating device for causing the first interlock device to take a non-operating condition when the second interlock device operates. Also, these two interlock devices are constituted to displace the home position returning lever in the same direction in each of a case of displacing the adjusting knob in the pressurizing direction and a case of displacing the adjusting knob in the depressurizing direction.

The first interlock device comprises: engagement between a driving gearwheel provided on an outer circumference of the adjusting knob and a driven gearwheel provided on the home position returning lever so as to have its initial position correspond to the home position of the adjusting knob; the home position returning lever being provided on a home position returning lever shaft and driven by rotation of the driven gearwheel; and a contact member provided on an output end of the home position returning lever for transmitting a home position returning motion to the home position returning lever.

The second interlock device is constituted by a connecting link having one end connected to the adjusting knob and another end connected to another end part of the home position returning lever whose initial position is caused to correspond to the home position of the adjusting knob so as to have the adjusting knob return to the home position by a home position returning motion of the adjusting knob.

The interlock obviating device of the first interlock device is constituted by engagement between a longitudinal arc hole provided in the driven gearwheel and extending along a direction of rotation, in a case of the gearwheel displacing from the home position, of the adjusting knob in the pressurizing direction, and a connecting pin provided at an end part of the home position returning lever.

The interlock obviating device of the second interlock device is constituted by engagement between a connecting pin, connecting the connecting link with the another end part of the home position returning lever, and a slot formed in the connecting link extending along a shifting direction in a case where the adjusting knob is displaced from the home position in the depressurizing direction.

Accordingly, structure of a home position returning device has been simplified.

Disposed along an outside of a displacement direction of each home position returning lever is a long size home position returning operation lever which is displaced in the same direction by operation of the first and second interlock devices so as to have the adjusting knob return to the home position by contact of the home position returning operation lever with the home position returning lever. The invention is effective for simplifying structure of the home position returning device and for greatly facilitating performance of a home position returning operation of each adjusting knob.

EFFECTS OF THE INVENTION

The thread tension regulating apparatus according to the present invention is constituted by providing: two interlock devices, i.e., the first interlock device and the second interlock device which are constituted so as not to interfere with mutual operating conditions between a thread tension regulation cam to meet a stitching method; a swinging piece; a spring bearing; and an adjusting knob for further finely adjusting a thread tension pressure of a thread tension unit and a home position returning operation lever. The home position returning lever is displaced in the same direction so as to become terminal ends of operation of the two interlock devices. Consequently, a home position returning structure has been simplified to reduce its cost, and also to make a returning operation simple, thereby further facilitating use of an over-lock sewing machine.

DESCRIPTION OF MARKS

Figure 1:
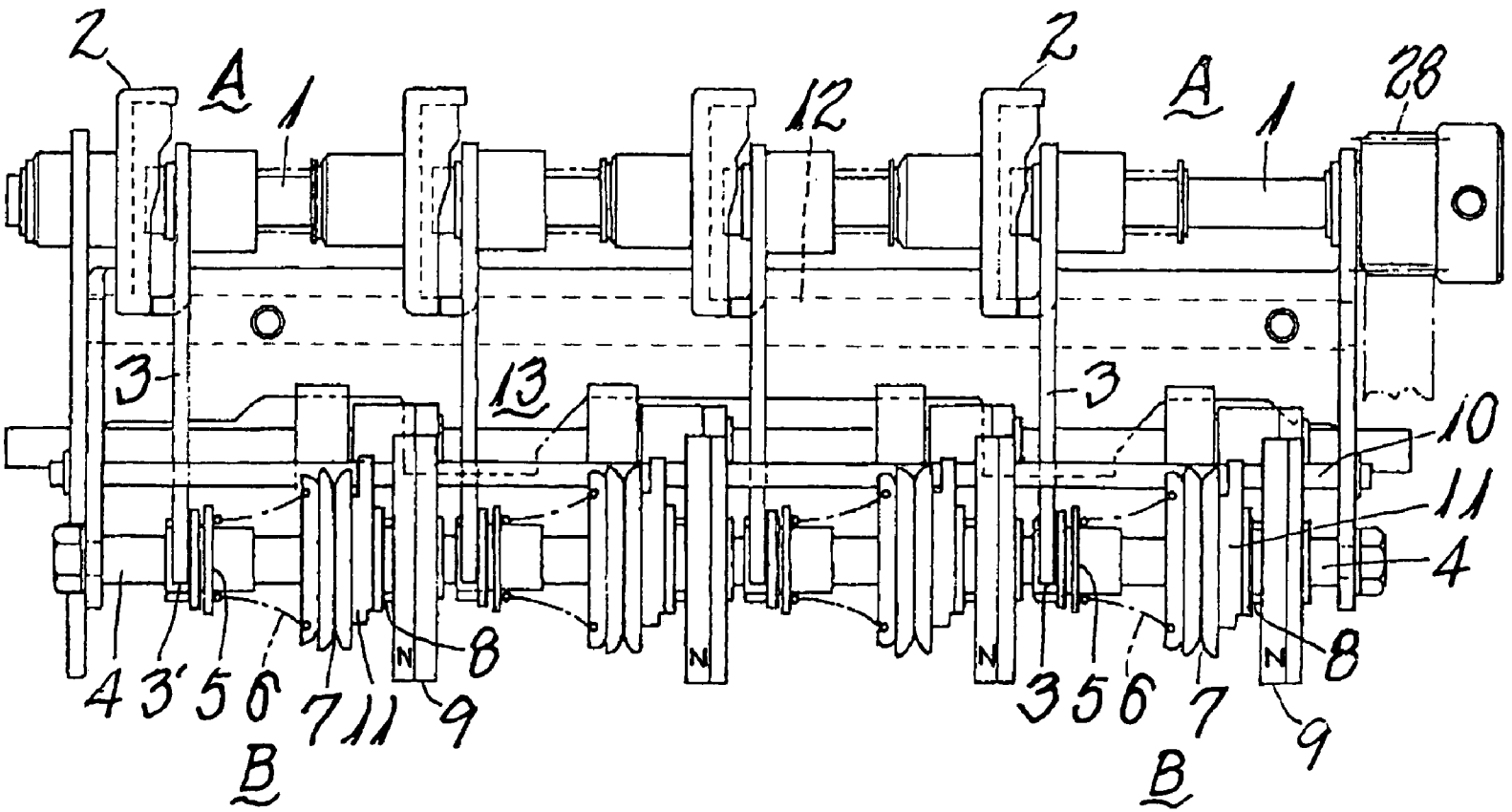
FIG. 1 is a front elevational showing an embodiment of the invention.

A Batch conversion device
B Fine adjustment device
C1 First interlock device
C2 Second interlock device
D1 First interlock obviating device
D2 Second interlock obviating device
1 Dial cam shaft
2 Thread tension regulation cam
3 Swing movement piece (3' tip portion)
4 Dial tension shaft
5 Spring bearing
6 Spring
7 Thread tension disc
8 Male screw
9 Adjusting knob
10 Supporting shaft
11 Fine adjustment operator
12 Home position returning operation shaft
13 Home position returning operation lever (13' Engaging member)
14 Driving gearwheel
15 Home position returning lever shaft
16 Driven gearwheel
17 Home position returning lever (17*a* Output end, 17*b* One end part, 17*c* Other end part)
18 Contact member
19 Connecting link (19' One end, 19" Other end)
20 Arc hole
21 Connecting pin
22 Slot
23 Connecting pin
24 Spring
25 Roller
26 Selection dial
27 Roller shaft
28 Transmission device
29 Ratchet gearwheel

DETAILED DESCRIPTION OF THE PREFERRED EMBODIMENTS

A thread tension regulation apparatus for an over-lock sewing machine is constituted by a batch conversion device comprising: a plurality of thread tension regulation cams, for setting a thread tension pressure adapted to a stitching method, fixed respectively to a dial cam shaft; swinging pieces which exhibit a swinging motion according to a set lift of a respective thread tension cam; a plurality of spring bearings provided on a dial tension shaft so as to be operable in a swinging motion by engaging tip portions of respective swinging pieces; and thread tension discs forming set thread tension pressures respectively under a spring force borne by respective spring bearings. The thread tension regulation apparatus also includes a fine adjustment device for finely adjusting the set thread tension pressures of the respective thread tension discs with respective adjusting knobs.

Additionally, there are provided two interlock devices comprising a first interlock device for displacing a home position returning lever toward a home position returning operation lever in response to motion of an adjusting knob of a thread tension unit displacing from the home position in a pressurizing direction, and a second interlock device for displacing the home position returning lever in response to motion of the adjusting knob displacing from the home position in a depressurizing direction.

The two interlock devices are provided respectively with an interlock obviating device for causing the second interlock device to take a non-operating condition when the first interlock device operates, and an interlock obviating device for causing the first interlock device to take a non-operating condition when the second interlock device operates.

These two interlock devices are constituted to displace the home position returning lever in the same direction in each of the case of displacing the adjusting knob in the pressurizing direction and the case of displacing the adjusting knob in the depressurizing direction.

Embodiment

Figure 2:
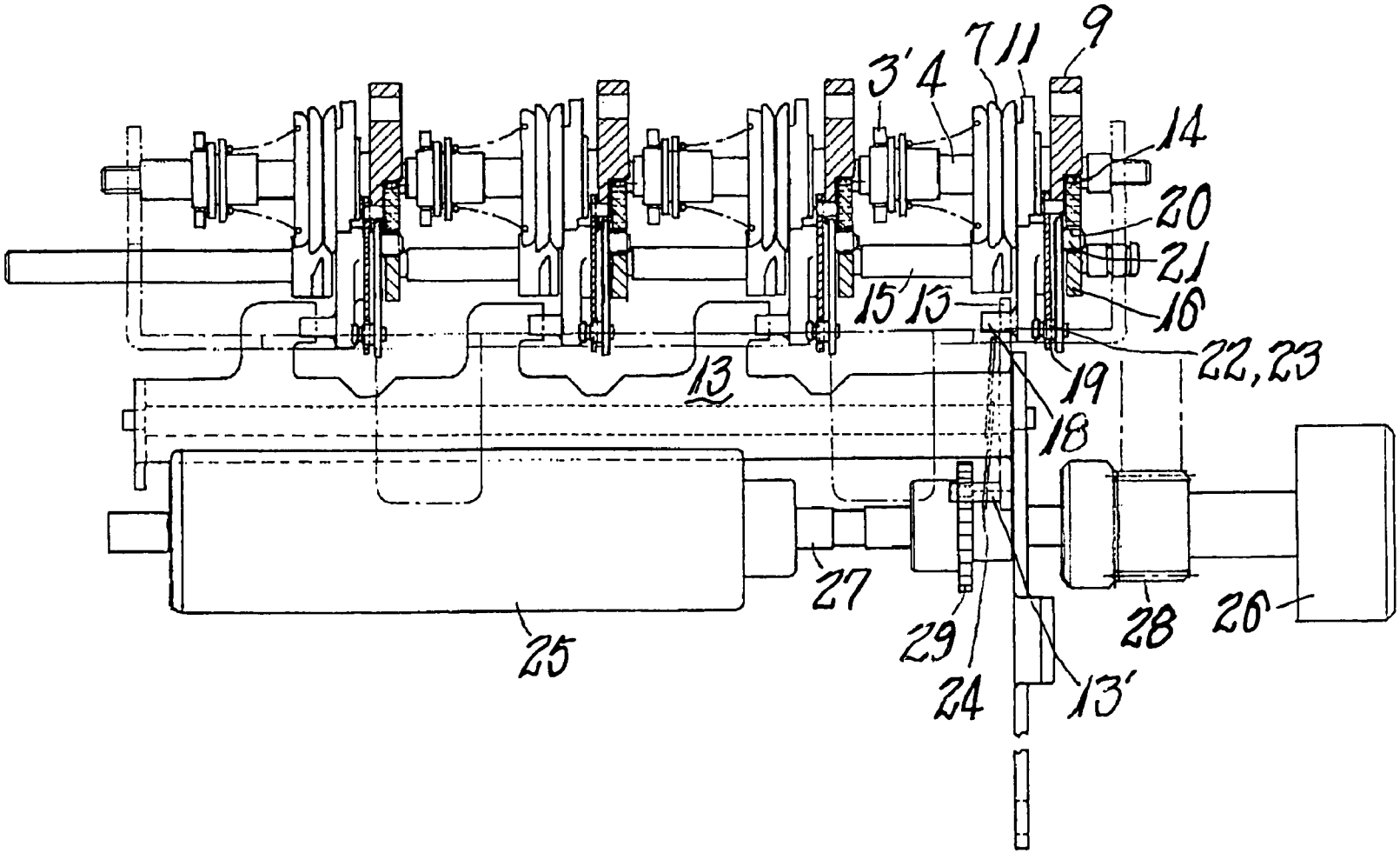
FIG. 2 is a plan view of the embodiment of the invention.
Figure 3:
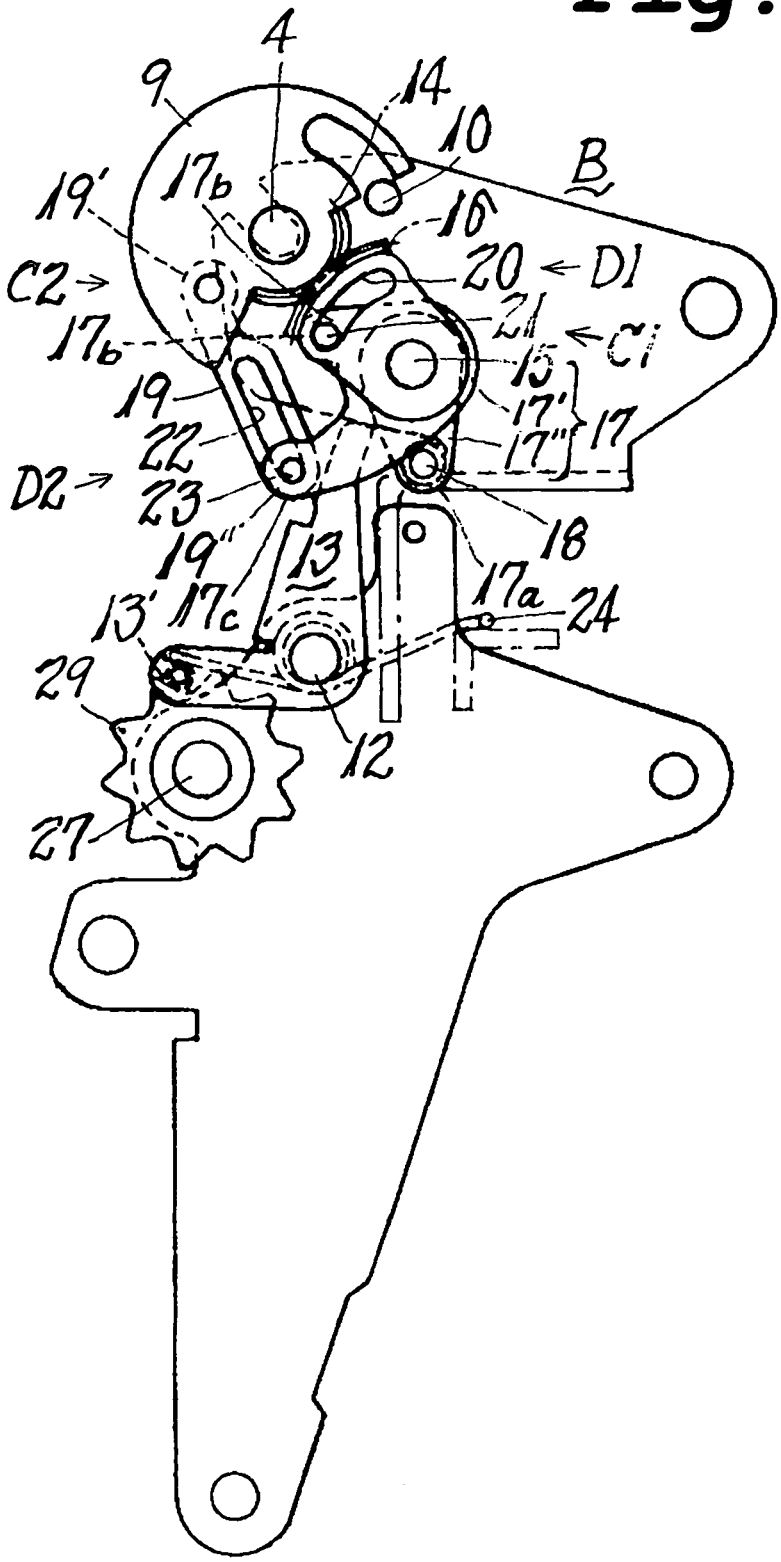
FIG. 3 is a partially cut side view in a case where an adjusting knob of the embodiment of the invention is placed in a home position.
Figure 4:
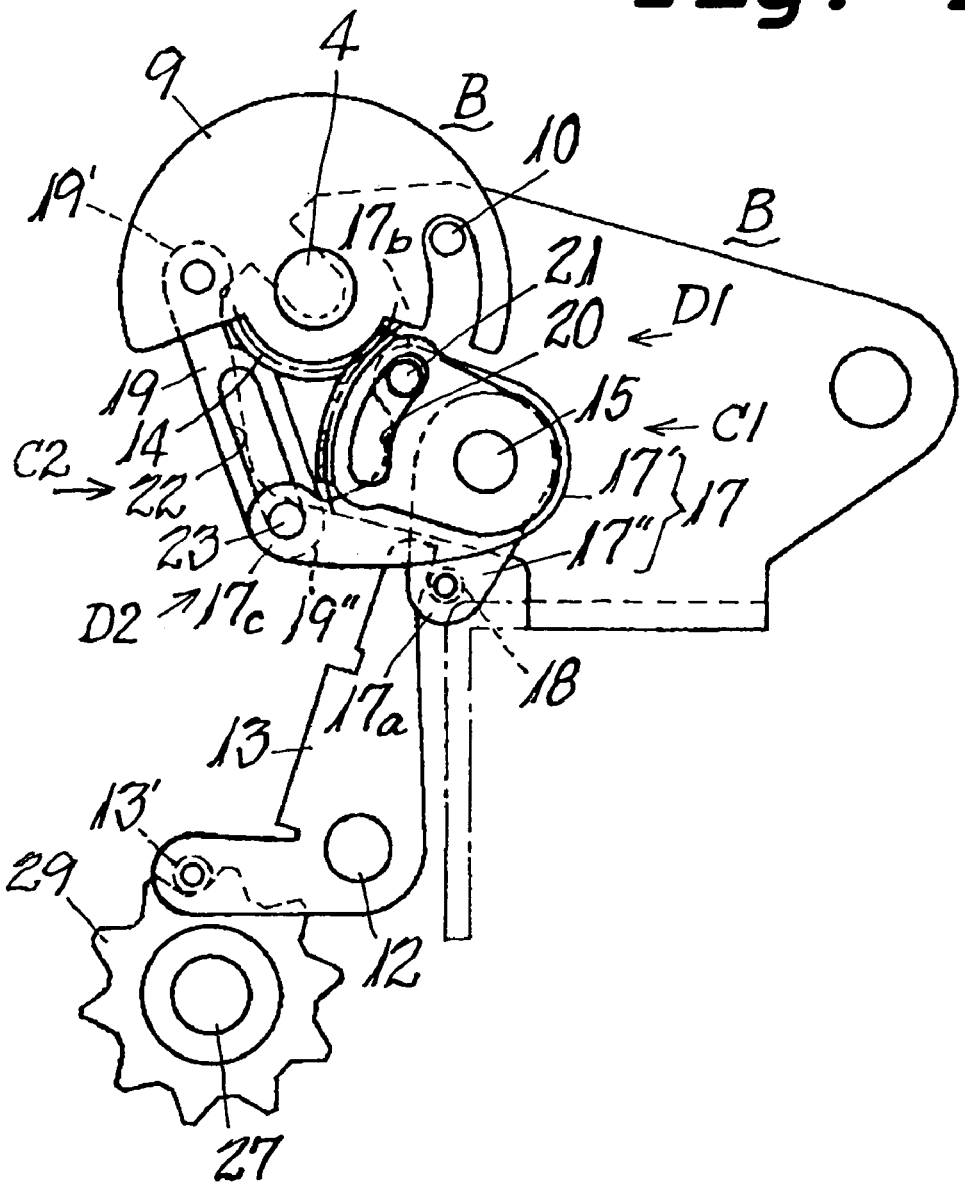
FIG. 4 is a partially cut side view illustrating operation of the embodiment of the invention.
Figure 5:
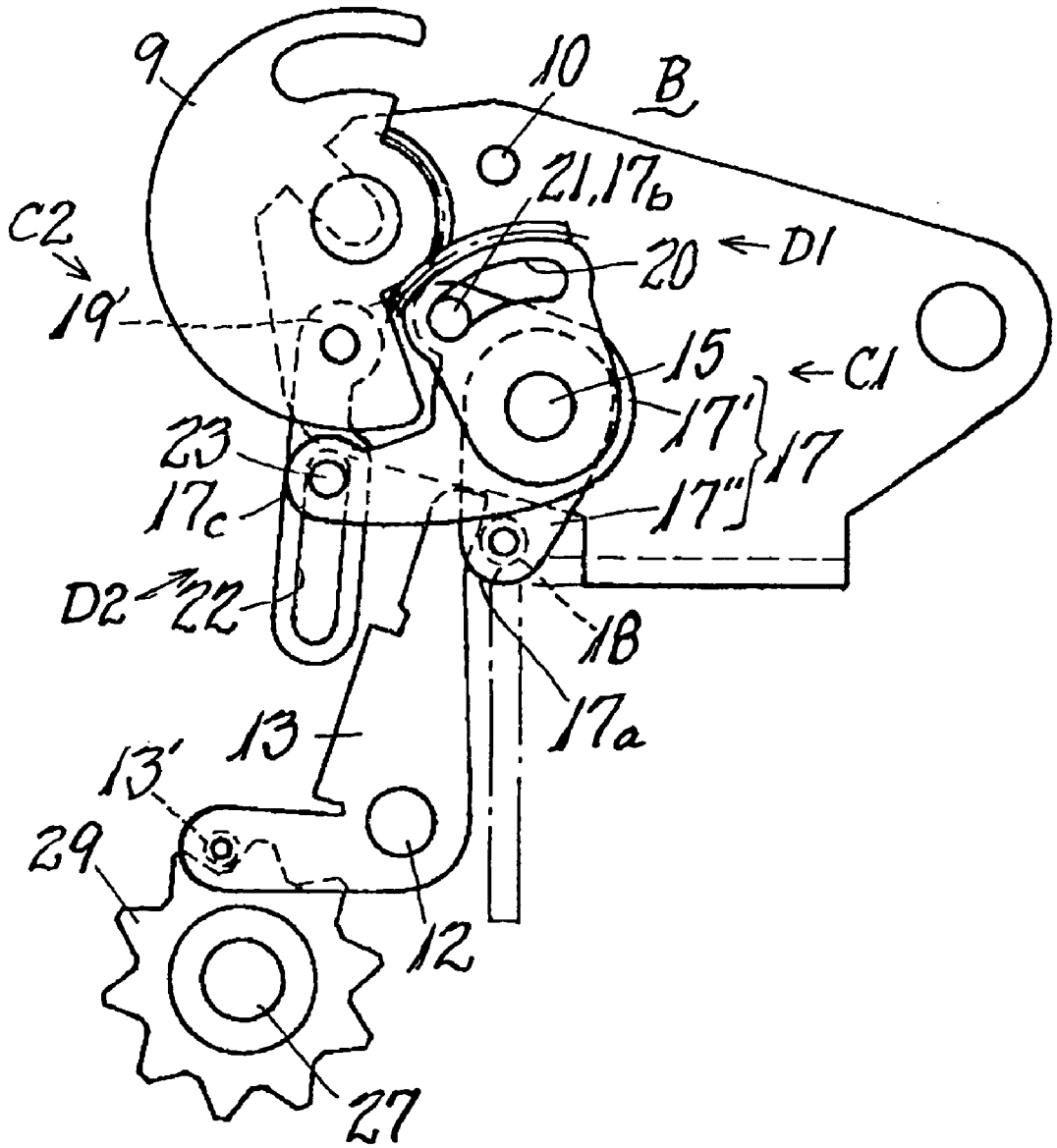
FIG. 5 is a partially cut side view illustrating the operation of the embodiment of the invention.

The drawings show an embodiment of the present invention. FIG. 1 is a partially cut plan view of the embodiment; FIG. 2 is a partially cut front view of the embodiment; FIG. 3 is a partially cut side view showing a case of an adjusting knob placed at a home position; FIG. 4 is a partially cut side view illustrating an operating condition; and FIG. 5 is likewise a partially cut side view illustrating the operating condition.

In the drawings illustrating the embodiment, (A) shows a batch conversion device comprising: a conventionally known dial cam shaft 1 in a thread tension regulating apparatus of this kind; a plurality of thread tension regulation cams 2 fixed respectively onto the dial cam shaft 1 by setting a thread tension pressure set in conformity with a sewing method; swinging pieces 3 which exhibit a swinging movement according to a set lift of each thread tension regulation cam 2; a plurality of spring bearings 5 provided on a dial tension setting shaft 4 and engaging tip portions 3' of respective swinging pieces 3; and a couple of thread tension discs 7 on right and left sides which form set thread tension pressures respectively by forces of springs 6 whose one end is supported by respective spring bearings 5.

B shows a fine adjustment device for finely adjusting the set thread tension pressures of respective thread tension regulation devices to desired thread tension pressures. This fine adjustment device B comprises: adjusting knobs 9 which are provided in a manner so as to be rotatable adjacent another side surface (on the right side of the illustration in FIGS. 1 and 2) of respective thread tension discs 7 by idly accommodating axial holes in the dial tension shaft 4, and having male screws 8 formed respectively on an outer circumference of end parts on the thread tension discs 7; and a female screwed fine adjustment operator 11 which is provided between the adjusting knob 9 and the thread tension discs 7 and spirally mating a male screw 8 of the adjusting knob 9 so that its rotation is inhibited by a bearing shaft.

In this embodiment, the fine adjustment device B operates in such a manner that, when the adjusting knob 9 is turned upward from a home position (in FIG. 1, shown as mark N), the fine adjustment operator 11 with the female screw retracts to the right side in this illustration on the dial tension shaft 4 to reduce the set thread tension pressure of the thread tension unit, and when the same is turned downward, the fine adjustment operator 11 advances to the right side in the illustration to operate in a manner to pressurize the set thread tension pressure of the thread tension unit.

In the present invention there are provided two interlock devices, i.e., a first interlock device C1 for displacing a home position returning lever 17 by being driven by motion of displacement of the adjusting knob 9, for finely adjusting the set thread tension pressure formed between the thread tension discs 7, from the home position in the pressurizing direction, and a second interlock device C2 for displacing the home position returning lever 17 by being driven by motion of displacement of the adjusting knob 9 from the home position in the depressurizing direction. The first and second interlock devices are provided between the adjusting knob 9 on the dial tension shaft 4 and a home position returning operation lever 13 idly accommodated on a home position returning operation shaft 12.

In this embodiment, the first interlock device C1 is constituted by: engagement between a driving gearwheel 14 provided on an outer circumference of the adjusting knob 9 and a driven gearwheel 16 provided idly on a home position returning lever shaft 15 so as to have its initial position correspond to the home position of the adjusting knob 9; the home position returning lever 17 provided on the home position returning lever shaft 15 and driven by rotation of the driven gearwheel 16; and a contact member 18 provided on an output end 17*a* of the home position returning lever 17.

The second interlock device C2 is constituted by a connection link 19 which connects an end 19' to the adjusting knob 9 and another end 19" to another end part 17*c* of the home position returning lever 17, and the contact member 18 provided on the output end 17*a* of the home position returning lever 17.

The above-described two interlock devices C1, C2 are respectively provided with interlock obviating devices D1, D2 which keep the other interlock device in a non-operating condition when one interlock device is operating; namely, which obviate an action of interlock with the adjusting knob 9 so that their operations are not interfered with each other.

The interlock obviating device D1 of the first interlock device C1 is provided on the driven gearwheel 16, and is constituted by an arc hole 20 provided in the driven gearwheel 16 longitudinally along a direction of rotation of the gearwheel in a case of displacing it by rotation of the adjustment knob 9 from the home position in the depressurizing direction, and a connecting pin 21 which is provided at an end part 17*b* of the home position returning lever 17 and is set in the arc hole 20 with its initial position made to correspond to the home position of the adjusting knob 9.

The interlock obviating device D2 of the second interlock device is constituted by a slot 22 which is provided on an interlink 19 and having a length corresponding to a displacement length of the adjusting knob 9 from its home position in the pressurizing direction, and a connecting pin 23 which is provided at another end part 17*c* of the home position returning lever 17 and is set in the slot 22 with its initial position made to correspond to the home position of the adjusting knob 9.

Next, a series of operations of the fine adjustment device B constituted as described above are illustrated with FIGS. 3, 4, and 5.

Firstly, when, as shown in FIG. 3, the adjusting knob 9 lying in the home position is rotated clockwise, due to a retreat of the fine adjustment operating member 11 a set thread tension pressure of the thread tension disc 7 is reduced, and on the other hand, with respect to the second interlock device C2, by rotation of the adjusting knob 9 the connecting pin 23 shifts in the same direction, and the home position returning lever 17, traced by the connecting pin 23, is likewise displaced clockwise as shown in FIG. 4, mediated by the connecting link and the other end part 17*c* of the home position returning lever 17 to displace the contact member 18 to a side of the home position returning operation lever 13. Rotations of the driving gearwheel 14 and the home position returning lever 17 in this case obviate an interlock movement of the first interlock device C1 by operation of the interlock obviating device D1, wherein the connecting pin 21 in the arc hole 20 of the driven gearwheel 16 shifts in an arc direction.

Further, when, as shown in FIG. 3, the adjusting knob 9 lying in the home position is rotated counter-clockwise, due to advance of the fine adjustment operating member 11 the set thread tension pressure of the thread tension disc 7 is pressurized, and on the other hand, with respect to the first interlock device C1, the driven gearwheel 16 which meshed with the driving gearwheel 14, with an initial position made to correspond to the home position of the adjusting knob 9, rotates clockwise. And, the home position returning lever 17, which engages the connecting pin 21 with one end (left end this figure) of the arc hole 20 of the driven gearwheel 16, rotates clockwise in the figure as in the case of the foregoing second interlock device C2, to displace the output end part 17*a* in the same direction and displace the contact member 18 to a side of the home position returning operation lever 13.

Rotation of the home position returning lever 17 in this case obviates an interlock of the second interlock device C2 by operation of the interlock obviating device D2 which causes displacement of the connecting pin 23 which had meshed with the other end 19" of the connecting link 19.

The home position returning lever 13, as shown in FIG. 2, has a length corresponding to an arrangement width of each thread tension unit, and by causing it to swing clockwise in FIG. 3 and resist the spring 24 provided at an end of the home position returning operation shaft 12, it causes to return each contact member 18, home position returning lever 17, and driven gearwheel 16 to an initial position, and the adjusting knob 9 to the home position, respectively.

In this embodiment, the home position returning lever 17 has a member 17' which is equipped at its one end 17*b* with the connecting pin 21 to be engaged with the driven gearwheel 16, and with the connecting pin 23 at its other end 17*c*, and a member 17" which is equipped at the output end 17*a* with a contact member 18. These two members are originally formed as separate objects and later combined into one-piece, which is provided on the home position returning lever shaft 15.

In the drawings, member 25 is a roller for selecting a stitching method; 26 is a selection dial fixed to an outer end of roller shaft 27; 28 is a transmission device comprising a pulley and a timing belt for transmitting a selected stitching method to the dial cam shaft 1; 29 is a latchet gearwheel fixed onto the roller shaft 27, and this gearwheel 29 acts, as shown in FIGS. 3, 4, and 5, to be engaged with an engaging member 13' provided at a lower end of the home position returning operation lever 13, to be driven by rotation of the above selection dial 26 and cause the home position returning lever 17 to return to the initial position from the displacement position, and to return the adjusting knob 9 to the home position.

POSSIBILITY OF INDUSTRIAL UTILIZATION

The thread tension regulating apparatus according to the present invention including the first interlock device, second interlock device, and the interlock obviating devices attached to the first and second interlock devices, respectively, is not limited to a mode of the embodiment, and needless to say details of it may be optionally subjected to alteration of design in line with a purpose of the present invention.

What is claimed is:

1. A thread tension regulating apparatus for an over-lock sewing machine, comprising:

a batch conversion device including (i) thread tension regulation cams, fixed on a dial cam shaft, for setting thread tension pressure adapted to a stitching method, (ii) swing pieces exhibiting a swinging motion according to a set lift of said thread tension regulation cams, respectively, (iii) spring bearings provided on a dial tension shaft so as to exhibit a swinging motion via engagement with ends of said swing pieces, respectively, and (iv) thread tension discs for forming set thread tension pressures, respectively, under spring forces supported by said spring bearings, respectively;

fine adjustment devices for finely adjusting, via respective adjusting knobs, the set thread tension pressures formed by said thread tension discs;

a home position returning member;

a first interlock device for displacing said home position returning member in a first direction in response to rotation of a respective one of the adjusting knobs from a home position in a pressurizing direction; and a second interlock device for displacing said home position returning member in the first direction in response to rotation of the respective one of the adjusting knobs from a home position in a depressurizing direction, wherein (i) said first interlock device includes a first interlock obviating device for causing said second interlock device to take a non-operating condition when said first interlock device operates, and (ii) said second interlock device includes a second interlock obviating device for causing said first interlock device to take a non-operating condition when said second interlock device operates.

2. The thread tension regulating apparatus according to claim 1, wherein said home position returning member comprises a home position returning lever.

3. The thread tension regulating apparatus according to claim 2, wherein said first interlock device comprises (i) a driving gearwheel, provided on an outer circumference of the respective one of the adjusting knobs, engaged with a driven gearwheel provided on a home position returning lever shaft, and (ii) a contact member provided on an output end of said home position returning lever for transmitting a home position returning motion to said home position returning lever, with said home position returning lever provided on said home position returning lever shaft such that said home position returning lever is driven by rotation of said driven gearwheel, and such that an initial position of said home position returning lever corresponds to the home position of the respective one of the adjusting knobs, said second interlock device comprises a connecting link having one end connected to the respective one of the adjusting knobs and another end connected to an end part of said home position returning lever, with an initial position of said connecting link corresponding to the home position of the respective one of the adjusting knobs such that the respective one of the adjusting knobs is returned to the home position by the home position returning motion transmitted to said home position returning lever, said first interlock obviating device comprises (i) an arc hole provided in said driven gearwheel and extending along a direction of rotation of said driven gearwheel resulting from the respective one of the adjusting knobs being rotated from the home position in the pressurizing direction, and (ii) a first connecting pin, provided at another end part of said home position returning lever, engaged with said arc hole, and said second interlock obviating device comprises (i) a slot in said connecting link and extending in a shifting direction generally corresponding to rotation of the respective one of the adjusting knobs from the home position in the depressurizing direction, and (ii) a second connecting pin engaged in said slot, with said second connecting pin being engaged in said slot serving to connect said another end of said connecting link to said end part of said home position returning lever.

4. The thread tension regulating apparatus according to claim 2, further comprising a home position returning operation lever, such that said first interlock device is for displacing said home position returning lever in the first direction toward said home position returning operation lever, and said second interlock device is for displacing said home position returning lever in the first direction toward said home position returning operation lever, with said first and second interlock devices being provided between the respective one of the adjusting knobs and said home position returning operation lever.

5. The thread tension regulating apparatus according to claim 4, wherein said home position returning lever is constructed and arranged such that the respective one of the adjusting knobs is to return to the home position by contact of said home position returning lever with said home position returning operation lever.

6. The thread tension regulating apparatus according to claim 4, wherein said first interlock device comprises (i) a driving gearwheel, provided on an outer circumference of the respective one of the adjusting knobs, engaged with a driven gearwheel provided on a home position returning lever shaft, and (ii) a contact member provided on an output end of said home position returning lever for transmitting a home position returning motion to said home position returning lever, with said home position returning lever provided on said home position returning lever shaft such that said home position returning lever is driven by rotation of said driven gearwheel, and such that an initial position of said home position returning lever corresponds to the home position of the respective one of the adjusting knobs, said second interlock device comprises a connecting link having one end connected to the respective one of the adjusting knobs and another end connected to an end part of said home position returning lever, with an initial position of said connecting link corresponding to the home position of the respective one of the adjusting knobs such that the respective one of the adjusting knobs is returned to the home position by the home position returning motion transmitted to said home position returning lever, said first interlock obviating device comprises (i) an arc hole provided in said driven gearwheel and extending along a direction of rotation of said driven gearwheel resulting from the respective one of the adjusting knobs being rotated from the home position in the pressurizing direction, and (ii) a first connecting pin, provided at another end part of said home position returning lever, engaged with said arc hole, and said second interlock obviating device comprises (i) a slot in said connecting link and extending in a shifting direction generally corresponding to rotation of the respective one of the adjusting knobs from the home position in the depressurizing direction, and (ii) a second connecting pin engaged in said slot, with said second connecting pin being engaged in said slot serving to connect said another end of said connecting link to said end part of said home position returning lever.

7. The thread tension regulating apparatus according to claim 6, wherein said home position returning lever is constructed and arranged such that the respective one of the adjusting knobs is to return to the home position by contact of said home position returning lever with said home position returning operation lever.

8. The thread tension regulating apparatus according to claim 1, further comprising a home position returning operation member, such that said first interlock device is for displacing said home position returning member in the first direction toward said home position returning operation member, and said second interlock device is for displacing said home position returning member in the first direction toward said home position returning operation member, with said first and second interlock devices being provided between the respective one of the adjusting knobs and said home position returning operation member.

9. The thread tension regulating apparatus according to claim 8, wherein said home position returning member is constructed and arranged such that the respective one of the adjusting knobs is to return to the home position by contact of said home position returning member with said home position returning operation member.

10. The thread tension regulating apparatus according to claim 8, wherein said first interlock device comprises (i) a driving gearwheel, provided on an outer circumference of the respective one of the adjusting knobs, engaged with a driven gearwheel provided on a home position returning member shaft, and (ii) a contact member provided on an output end of said home position returning member for transmitting a home position returning motion to said home position returning member, with said home position returning member provided on said home position returning member shaft such that said home position returning member is driven by rotation of said driven gearwheel, and such that an initial position of said home position returning member corresponds to the home position of the respective one of the adjusting knobs, said second interlock device comprises a connecting link having one end connected to the respective one of the adjusting knobs and another end connected to an end part of said home position returning member, with an initial position of said connecting link corresponding to the home position of the respective one of the adjusting knobs such that the respective one of the adjusting knobs is returned to the home position by the home position returning motion transmitted to said home position returning member, said first interlock obviating device comprises (i) an arc hole provided in said driven gearwheel and extending along a direction of rotation of said driven gearwheel resulting from the respective one of the adjusting knobs being rotated from the home position in the pressurizing direction, and (ii) a first connecting pin, provided at another end part of said home position returning member, engaged with said arc hole, and said second interlock obviating device comprises (i) a slot in said connecting link and extending in a shifting direction generally corresponding to rotation of the respective one of the adjusting knobs from the home position in the depressurizing direction, and (ii) a second connecting pin engaged in said slot, with said second connecting pin being engaged in said slot serving to connect said another end of said connecting link to said end part of said home position returning member.

11. The thread tension regulating apparatus according to claim 10, wherein said home position returning member is constructed and arranged such that the respective one of the adjusting knobs is to return to the home position by contact of said home position returning member with said home position returning operation member.

12. The thread tension regulating apparatus according to claim 1, wherein said first interlock device comprises (i) a driving gearwheel, provided on an outer circumference of the respective one of the adjusting knobs, engaged with a driven gearwheel provided on a home position returning member shaft, and (ii) a contact member provided on an output end of said home position returning member for transmitting a home position returning motion to said home position returning member, with said home position returning member provided on said home position returning member shaft such that said home position returning member is driven by rotation of said driven gearwheel, and such that an initial position of said home position returning member corresponds to the home position of the respective one of the adjusting knobs, said second interlock device comprises a connecting link having one end connected to the respective one of the adjusting knobs and another end connected to an end part of said home position returning member, with an initial position of said connecting link corresponding to the home position of the respective one of the adjusting knobs such that the respective one of the adjusting knobs is returned to the home position by the home position returning motion transmitted to said home position returning member, said first interlock obviating device comprises (i) an arc hole provided in said driven gearwheel and extending along a direction of rotation of said driven gearwheel resulting from the respective one of the adjusting knobs being rotated from the home position in the pressurizing direction, and (ii) a first connecting pin, provided at another end part of said home position returning member, engaged with said arc hole, and said second interlock obviating device comprises (i) a slot in said connecting link and extending in a shifting direction generally corresponding to rotation of the respective one of the adjusting knobs from the home position in the depressurizing direction, and (ii) a second connecting pin engaged in said slot, with said second connecting pin being engaged in said slot serving to connect said another end of said connecting link to said end part of said home position returning member.

* * * * *

UNITED STATES PATENT AND TRADEMARK OFFICE

CERTIFICATE OF CORRECTION

PATENT NO. : 7,069,869 B2
APPLICATION NO. : 11/029480
DATED : July 4, 2006
INVENTOR(S) : Yoshihiro Kashima It is certified that error appears in the above-identified patent and that said Letters Patent is hereby corrected as shown below:

ON THE TITLE PAGE

Item (12) Inventor's Name:

"Kashina" should read --Kashima--.

Title Page
Item (75) Inventor:

"Yoshihiro Kashina" should read --Yoshihiro Kashima--.

Signed and Sealed this

Twenty-first Day of November, 2006

JON W. DUDAS
*Director of the United States Patent and Trademark Office*